US005720620A

United States Patent [19]

Nobe et al.

[11] Patent Number: 5,720,620

[45] Date of Patent: Feb. 24, 1998

[54] COAXIAL CONNECTOR

[75] Inventors: Takeshi Nobe; Ikujiro Mitani, both of Tokyo, Japan

[73] Assignee: Hirose Electric Co., Ltd., Tokyo, Japan

[21] Appl. No.: 621,961

[22] Filed: Mar. 26, 1996

[30] Foreign Application Priority Data

Jun. 20, 1995 [JP] Japan ..... 7-175636

[51] Int. Cl.[6] ..... H01R 9/09

[52] U.S. Cl. ..... 439/63; 439/608

[58] Field of Search ..... 439/63, 581, 608, 439/857, 248

[56] References Cited

U.S. PATENT DOCUMENTS

| | | | |
|---|---|---|---|
| 3,955,869 | 5/1976 | Licht | 439/857 X |
| 4,932,906 | 6/1990 | Kaley et al. | 439/857 OR |
| 5,141,453 | 8/1992 | Fusselman et al. | 439/608 OR |
| 5,403,206 | 4/1995 | McNamara et al. | 439/608 OR |

*Primary Examiner*—David Pirlot
*Assistant Examiner*—Daniel Wittels
*Attorney, Agent, or Firm*—Kanesaka & Takeuchi

[57] ABSTRACT

A pair of male and female coaxial connectors which includes male and female rectangular housings with a plurality of through holes arranged at a predetermined interval in a lengthwise direction of the rectangular housing in which male and female terminals are arranged in at least one line. The male terminals includes a plurality of male outer conductors each fitted in one of the through holes and having upper and lower inner surfaces extending parallel to a specified plane which extends in the lengthwise direction and in a widthwise direction of the rectangular housing; a plurality of male dielectric blocks each fitted in a rear portion of one of the male outer conductors to define a cavity within the one male outer conductor; and a plurality of male central conductors each projecting into the cavity from one of the dielectric blocks and having upper and lower outer surfaces extending parallel to the specified plane.

3 Claims, 3 Drawing Sheets

COAXIAL CONNECTOR

BACKGROUND OF THE INVENTION

1. Field of the Invention

The present invention relates to coaxial connectors.

2. Description of the Related Art

Coaxial connectors include a pair of male and female terminals. The terminals include an outer conductor and a central conductor supported by a dielectric block within the outer conductor. The male terminal includes a front cavity within the outer conductor for receiving a female terminal. The central conductor of the male terminal has a pin-like shape supported by the dielectric block provided in a rear portion of the terminal and extends into the front cavity. The female terminal include a cylindrical outer conductor to be fitted into the outer conductor of the male terminal. The female outer conductor includes the dielectric block with a through hole into which the female central conductor is fitted for receiving the male central conductor.

Both of the outer and central conductors have a circular cross section, and a pair of male and female terminals are used for coaxial connectors. The coaxial connectors with circular conductors are easy to make.

There is a need to connect a large number of pairs of such male and female terminals simultaneously. To fill such a need, it has been proposed that a number of male and female terminals are arranged at regular intervals in male and female housing, respectively, and both the housing are plugged into each other to connect the male and female terminals simultaneously.

However, if there is a manufacturing error in the distance between the adjacent terminals arranged in the housing, not all of the male and female terminals are connected without difficulty. To solve such a problem, there has been proposed the so-called floating structure in which the terminals are movable relative to the housing so as to absorb the error. This structure however is very complicated and the distance between the terminals has to be large, resulting in a disadvantageously large connector.

Such a problem results from the fact that all of the outer conductor, dielectric block, and central conductor have a circular cross section go that if there is an error in the distance between them, the respective parts of the circular form interfere with each other.

Accordingly, it is an object of the invention to provide a simple connector structure capable of being connected without difficulty even if there is a certain amount of error in the distance between terminals arranged in a housing at regular intervals in rows, thus eliminating the complex floating structure.

According to the invention there is provided a pair of male and female coaxial connectors which includes male and female rectangular housings with a plurality of through holes arranged at a predetermined interval in a lengthwise direction of the rectangular housing in which male and female terminals are arranged in at least one line. The male terminals includes a plurality of male outer conductors each fitted in one of the through holes and having upper and lower inner surfaces extending parallel to a specified plane which extends in the lengthwise direction and in a widthwise direction of the rectangular housing; a plurality of male dielectric blocks each fitted in a rear portion of one of the male outer conductors to define a cavity within the one male outer conductor; and a plurality of male central conductors each projecting into the cavity from one of the dielectric blocks and having upper and lower outer surfaces extending parallel to the specified plane. The female terminals includes a plurality of female outer conductors having upper and lower outer surfaces which are brought into contact with the upper and lower inner surfaces of the male terminals and side outer surfaces with spaced from the male inner side surfaces by a predetermined gap; a plurality of female dielectric blocks provided within the female outer conductors; a plurality of female central conductors supported by the female dielectric blocks and having a pair of upper and lower front portions holding the male central conductors between them so that the male terminals are movable relative to the female terminals in a plane parallel to the specified plane.

The outer and inner conductors of male and female connector are brought into contact with each other in planes parallel to the specified plane, and there is a predetermined gap between the outer conductors of male and female connector in the lengthwise direction of the rectangular housings so that the terminals are movable in the lengthwise direction to provide a Satisfactory contact even as far as the amount of an error in the distance between the adjacent terminals is within the tolerance range.

DESCRIPTION OF THE PREFERRED EMBODIMENT

Figure 1:
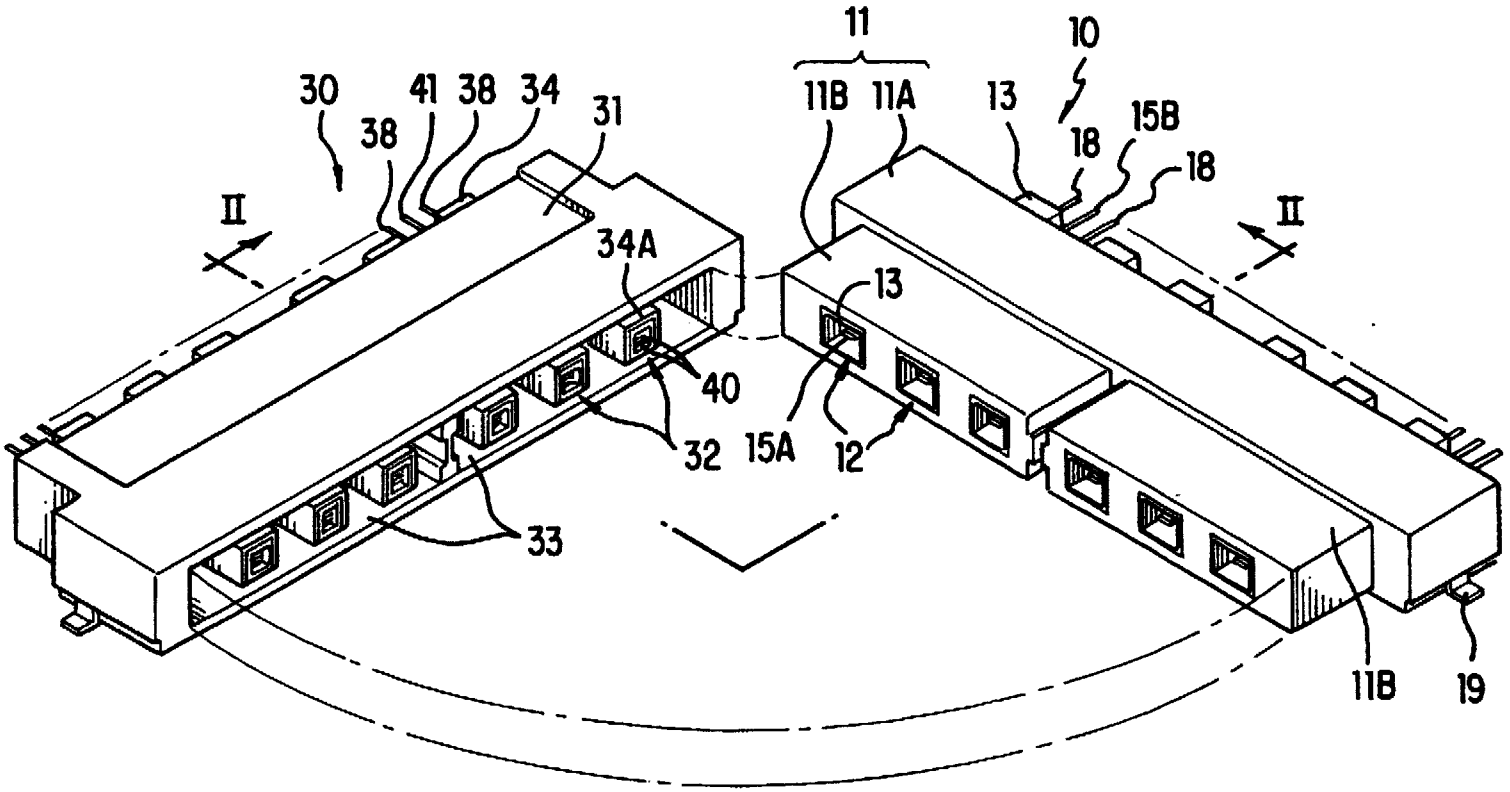
FIG. 1 is a perspective view of a pair of coaxial connectors according to an embodiment of the invention.

In FIG. 1, a male connector 10 includes a rectangular housing 11 made from an insulation material and coaxial male terminals 12 arranged at six locations at regular intervals in the lengthwise direction of the housing 11. A female connector 30 includes a rectangular housing 31 of an insulation material and female terminals 32 arranged at six locations corresponding to the male terminals 12.

Figure 2:
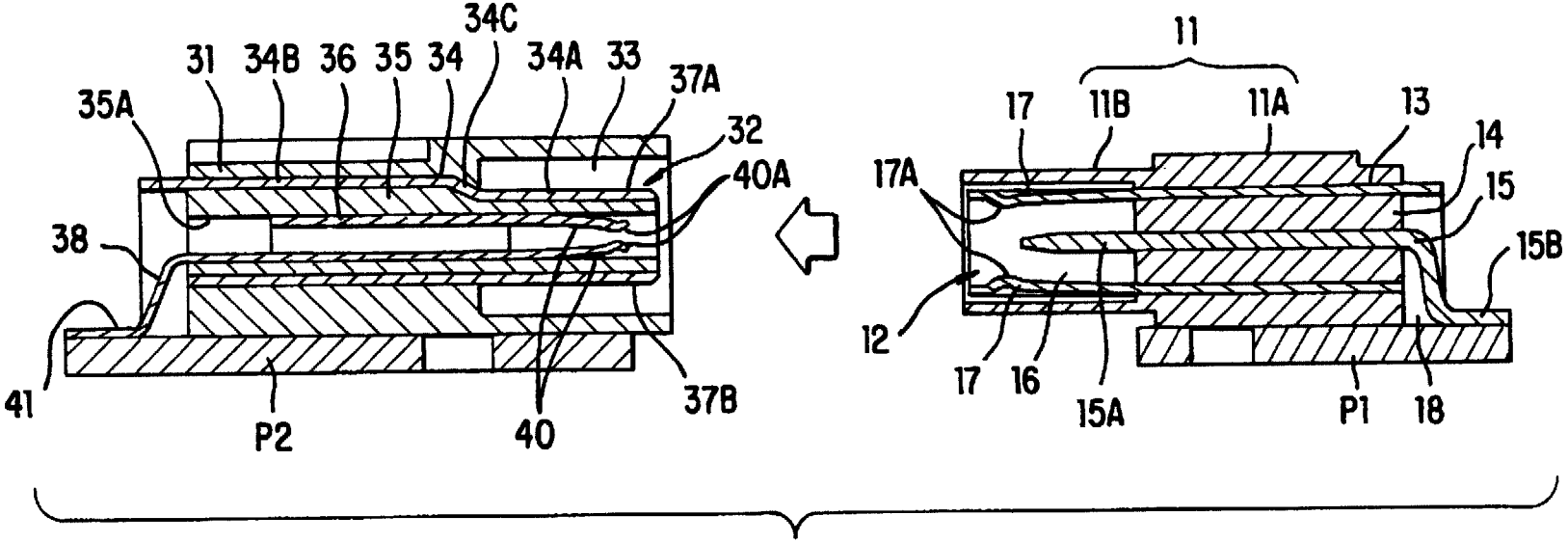
FIG. 2 is a sectional view taken along line II—II of FIG. 1.

The male housing 11 includes a body section 11A and two protruded sections 11B extending forwardly from the body section 11A, each section having three cavities in which each male terminal 12 is disposed. As best shown in FIG. 2, each male terminal 12 includes an outer conductor 13, a dielectric block 14, and a central conductor 15 supported by the dielectric block 14 at the center of the outer conductor 13.

The outer conductor 13 is made in a substantially rectangular cylindrical form by a press and supported by the body section 11A of the housing 11 such that it extends into a cavity 16 of the protruded section 11B with a small gap provided from the wall of the cavity 16. That is, the upper and lower walls of the outer conductor 13 extend parallel to a plane (hereinafter called "specified plane") that includes both the lengthwise direction of the male terminals 12 and the widthwise direction of the rectangular connector. A pair of resilient tongue pieces 17 are cut out of the upper and lower walls to provide an opposed throat portions 17A within the cavity 16. A connection section 18 extends rearwardly from a rear end of the outer conductor 13 which projects from the body section 11A of the housing 11 for connection to a circuit board P1 (also see FIG. 1).

A front portion 15A of the central conductor 15 extends into the cavity 16 of the protruded section 11B while a rear portion is bent downwardly at the rear end of the body section 11A to provide a connection portion 15B to be connected on the circuit board P1. The central conductor 15 is made from a fine strip of sheet metal, and the front portion 15A has upper and lower surfaces which are parallel to the specified plane and the upper and lower walls of the outer conductor 13 (also see FIG. 1). The tip of the front portion 15A is tapered as best shown in FIG. 2.

The male connector 10 is secured to the circuit board by inserting a projection (not shown) into a positioning hole of the circuit board and soldering L-shaped metal fittings 19 provided on opposite sides of the body section 11A.

Two receiving recesses 33 are provided in a front portion of the female housing 31 for receiving the protruded sections 11B of the male connector 10. Three through holes extend rearwardly from each receiving recess 33 at regular intervals into which female terminals 32 are inserted from back.

The female terminal 32 includes an outer conductor 34, a dielectric block 35, and a central conductor 36. The outer conductor 34 is made from metal sheet by a press in a substantially rectangular cylindrical form with a slant portion 34C with which a front portion 34A is made thinner than a rear portion 34B as shown in FIG. 2. Outer surfaces 37A and 37B of the front portion 34A extend parallel to the specified plane so that they are brought into contact with the resilient tongue pieces 17 of the male connector 10. A rear portion of the outer conductor 34 is bent downwardly at a rear end of the housing 31 to form a connection portion 38 which is connected to another circuit board P2 (also see FIG. 1).

The dielectric block 35 has a through hole 35A in which the central conductor 36 is inserted from back. The central conductor 36 has a shape similar to that of the outer conductor 13 of the male connector 10; i.e., it has a rectangular tube middle portion with upper and lower walls extending parallel to the specified plane and having resilient tongue pieces 40 extending forwardly therefrom. Front portions of the resilient tongue pieces 40 form a throat portion 40A with a gap sufficiently large to make a resilient contact with the central conductor 15 of the male connector 10. A rear portion of the central conductor 36 is bent downwardly to form a connection portion 41 to be connected to the circuit board P2.

After the male and female connectors 10 and 30 are positioned on the circuit boards P1 and P2, respectively, the connection portions 18 and 15B of the outer and central conductors 13 and 15 for the male connector 10 and the connection portions 38 and 41 of the outer and central conductors 34 and 36 for the female connector 30 are soldered to the corresponding conductors of the circuit boards P1 and P2, respectively. Then, the male and female connectors 10 and 30 are plugged into each other by inserting the protruded sections 11B of the male connector 10 into the receiving recesses 33 of the female connector 30 as shown in FIG. 1. As a result, the tongue pieces 17 of the male connector 10 are brought into spring contact with the outer surfaces 37A and 37B of the female connector 30 while the front portion 15A of the male connector 10 is brought into spring contact with the throat portion 40A of the female connector 30.

Figure 3:
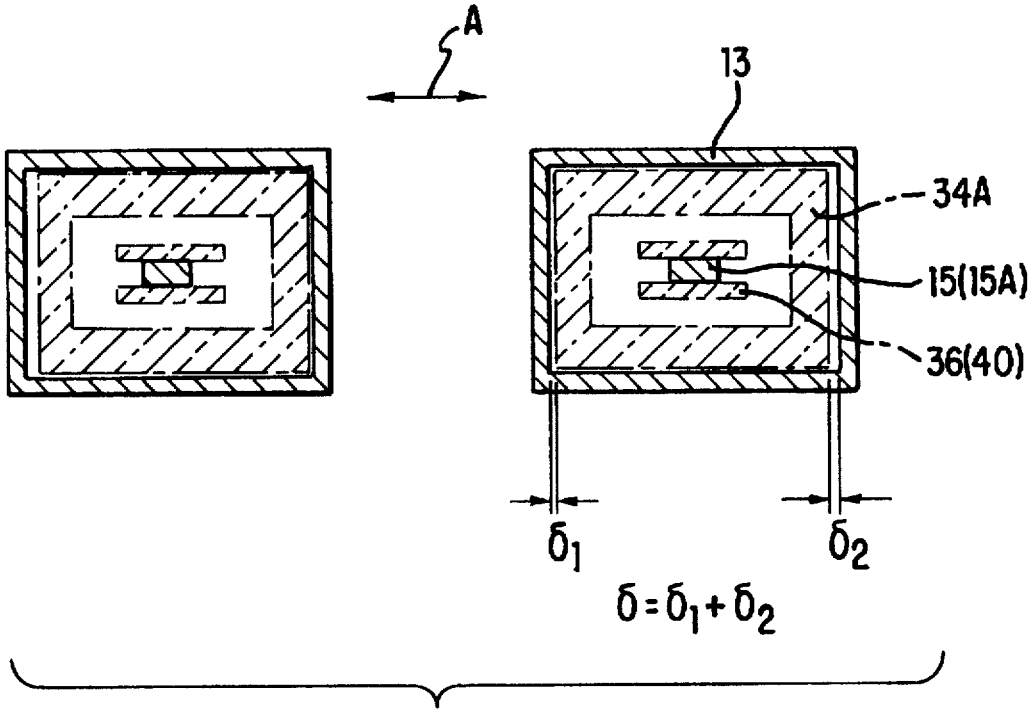
FIG. 3 is a cross sectional view of terminals of the coaxial connector under connection conditions.

Thus, the outer conductors 13 and 34 and the central conductors 15 and 36 of the male and female connector 10 and 30 are electrically connected as shown in FIG. 3, wherein only two pairs of outer and central conductors of the male and female connectors are shown by solid and phantom lines, respectively.

A predetermined gap is provided between the outer conductor 13 of the male connector 10 and the front portion 34A of the female connector 30 in the lengthwise direction of the rectangular housing (A) to provide a tolerance so that the male and female connectors are connected without problems as far as the variations of the connectors are within the tolerance. The central conductors 15 (or front portion 15A) and 36 (or resilient tongue 40) of the male and female connectors 10 and 30 are thus movable with respect to each other in a direction parallel to the specified plane to absorb the variations.

Alternatively, the side faces of outer and central conductors at right angles with the specified plane may take any shape as far as the upper and lower surfaces of the conductors are parallel to the specified plane. For example, they may take an arcuate, polygonal, or stepped shape.

The terminals may be arranged in plural rows.

As described above, according to the invention the connectors are made to provide a tolerance in a direction parallel to the specified plane so that poor electrical connection is minimized even if there are some variations in the manufacture. The tolerance eliminates the need for the so-called floating structure, thus minimizing the manufacturing costs and the size of the connector.

The invention claimed is:

1. A pair of male and female coaxial connectors comprising male and female rectangular housings with a plurality of through holes arranged at a predetermined interval in a lengthwise direction of said rectangular housing in which male and female terminals are arranged in at least one line, said male terminals comprising:

a plurality of male outer conductors each fitted in one of said through holes and having upper and lower inner surfaces extending parallel to a specified plane which extends in said lengthwise direction and in a widthwise direction of said rectangular housing;

a plurality of male dielectric blocks each fitted in a rear portion of one of said male outer conductors to define a cavity within said one male outer conductor; and a plurality of male central conductors each projecting into said cavity from one of said dielectric blocks and having upper and lower outer surfaces extending parallel to said specified plane, and said female terminals comprising:

a plurality of female outer conductors having upper and lower outer surfaces which are brought into contact with said upper and lower inner surfaces of said male terminals and side outer surfaces with spaced from said male inner side surfaces by a predetermined gap;

a plurality of female dielectric blocks provided within said female outer conductors;

a plurality of female central conductors supported by said female dielectric blocks and having a pair of upper and lower front portions holding said male central conductors between them so that said male terminals are movable relative to said female terminals in a plane parallel to said specified plane.

2. A pair of coaxial connectors according to claim 1, wherein said male and female outer conductors have a rectangular cross section.

3. A pair of coaxial connectors according to claim 1, wherein at least two lines of male and female terminals are arranged at positions corresponding to each other.

* * * * *